US005102103A

United States Patent [19]

Putnam

[11] Patent Number: 5,102,103

[45] Date of Patent: Apr. 7, 1992

[54] CHILD SAFETY FENCE

[76] Inventor: Theo O. Putnam, P.O. Box 21031, Wickenburg, Ariz. 85358

[21] Appl. No.: 498,431

[22] Filed: Mar. 26, 1990

[51] Int. Cl.[5] ..... E04H 17/00; G08B 13/12

[52] U.S. Cl. ..... 256/12; 256/25; 340/541

[58] Field of Search ..... 256/25, 10–12, 256/23, 24, 29, 30, 1, 26, 32, 37, 45; 340/550, 541; 49/13, 14

[56] References Cited

U.S. PATENT DOCUMENTS

| | | | |
|---|---|---|---|
| 2,073,834 | 3/1937 | Duany et al. | 49/13 X |
| 2,403,503 | 7/1946 | Coulter . | |
| 2,942,247 | 6/1960 | Lienau et al. . | |
| 3,439,455 | 4/1969 | Ford | 256/11 X |
| 3,469,822 | 9/1969 | O'Brien | 256/26 X |
| 3,534,356 | 10/1970 | Bagno . | |
| 3,713,132 | 1/1973 | Tonkowich et al. | 340/550 X |
| 4,005,397 | 1/1977 | Blair | 256/1 X |
| 4,155,083 | 5/1979 | Slaats et al. | 340/541 X |
| 4,209,776 | 6/1980 | Frederick | 340/541 |
| 4,220,949 | 9/1980 | Pope et al. | 256/10 X |
| 4,518,953 | 5/1985 | Hunter et al. | 256/10 X |
| 4,695,677 | 9/1987 | Ruth et al. | 256/10 X |
| 4,829,289 | 5/1989 | Kerr et al. | 340/541 |
| 4,916,433 | 4/1990 | Ver Loren van Themaat | 256/12 X |
| 4,920,331 | 4/1990 | Ver Loren van Thermaat | 340/550 X |
| 4,929,926 | 5/1990 | Porat | 340/541 |

*Primary Examiner*—Peter M. Cuomo
*Attorney, Agent, or Firm*—Donald A. Kettlestrings

[57] ABSTRACT

A child safety fence for preventing unsupervised children from entering swimming pools includes a plurality of spaced apart substantially vertical supports having a flexible line extending between and slidably supported by the supports. A flexible netting is attached to the flexible line and extends between the supports to form a physical barrier. The flexible line is connected to an audible alarm signal so that weight on the netting or the flexible line causes activation of the alarm signal.

13 Claims, 3 Drawing Sheets

CHILD SAFETY FENCE

BACKGROUND OF THE INVENTION

This invention relates to safety fences and more particularly to a child safety fence for preventing unsupervised children from entering swimming pools.

Various types of security and safety fences are known, but most safety fences with alarms are technically complex and expensive to install and to maintain.

SUMMARY OF THE INVENTION

It is, therefore, an object of the present invention to provide a child safety fence which is easy and inexpensive to manufacture, install and to maintain.

Another object is to provide a child safety fence for preventing unsupervised children from entering swimming pools or other areas.

Still another object is to provide a child safety fence which sounds an alarm if an unsupervised child attempts to climb the fence.

Yet another object of the present invention is the provision of a child safety fence which will sound an alarm if an unsupervised child attempts to gain entry to the swimming pool via the gate in the fence.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects the present invention provides a security fencing system which includes a plurality of spaced apart substantially vertical supports; a first upper flexible line defining first and second ends and extending between and slidably supported by the supports; a first lower support extending between the vertical supports; a first flexible netting attached to and extending between the first line and the lower support; means for sounding an audible alarm signal; and wherein the first and second ends of the line are in operative relationship with the sounding means for enabling activation of the alarm signal when the netting and the line are pulled downwardly, as by the weight of an intruder; and gate means between first and second of the vertical supports.

It is to be understood that both the foregoing general description and the following detailed description are exemplary and explanatory but are not restrictive of the invention.

The accompanying drawings, which are incorporated in and constitute a part of this specification, illustrate an example of a preferred embodiment of the invention and, together with the description, serve to explain the principles of the invention.

DETAILED DESCRIPTION OF THE PREFERRED EMBODIMENT

Figure 1:
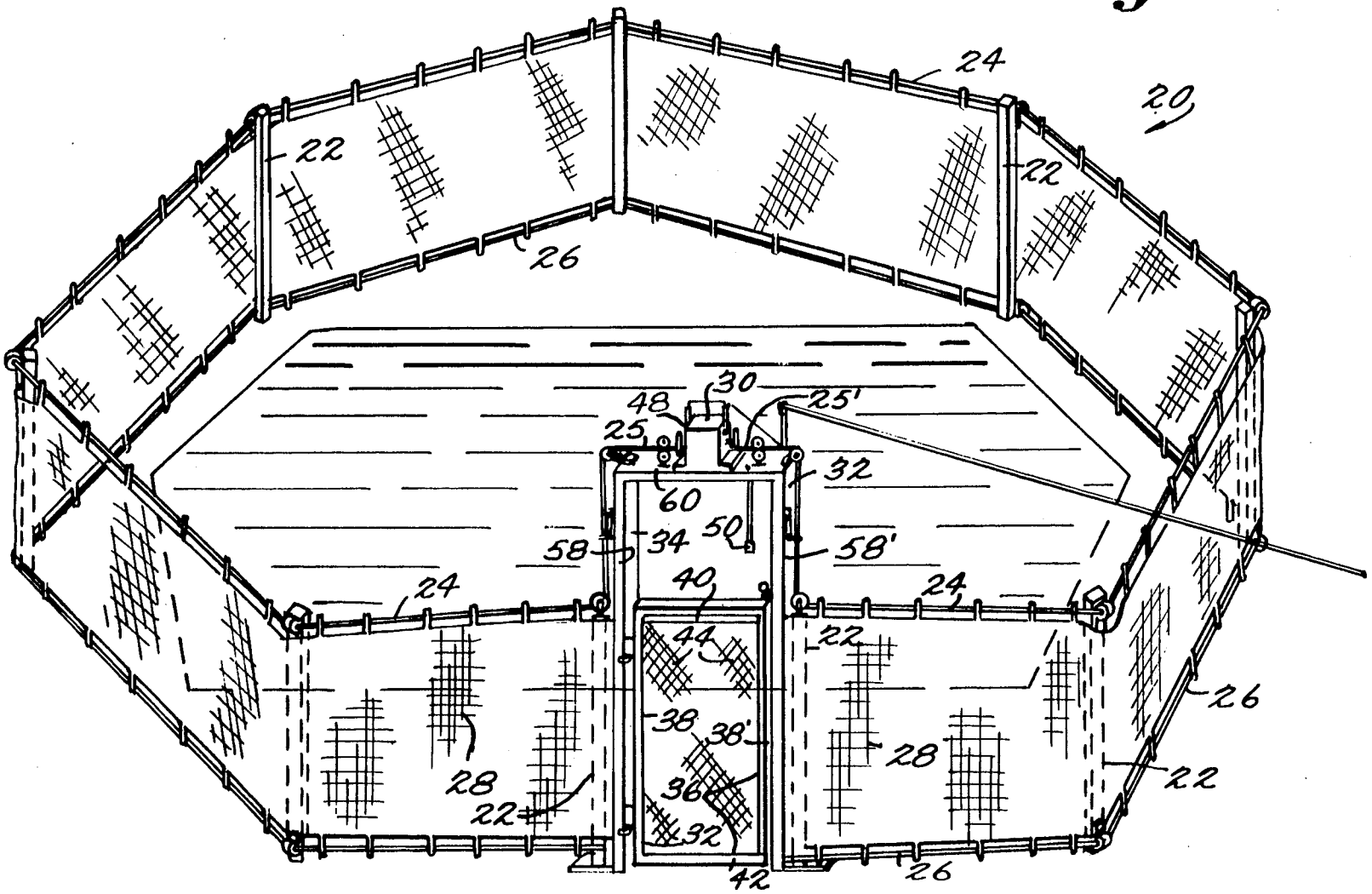
FIG. 1 is a perspective view of the fence.
Figures 2, 3:
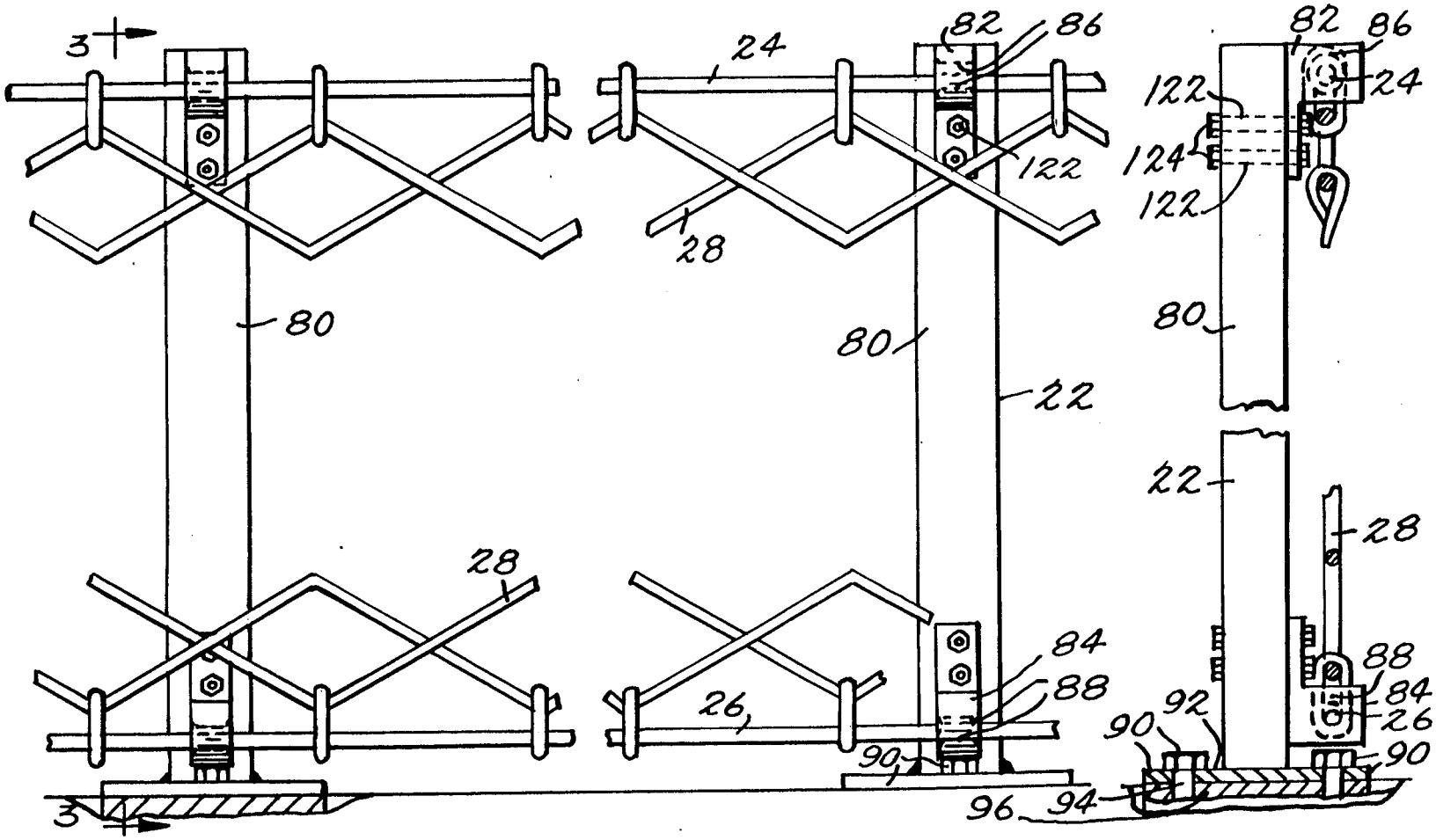
FIG. 2 is a fragmentary front elevation view of a portion of the fence.
FIG. 3 is a cross-sectional view taken along the line 3—3 in FIG. 2 and looking in the direction of the arrows.
Figure 4:
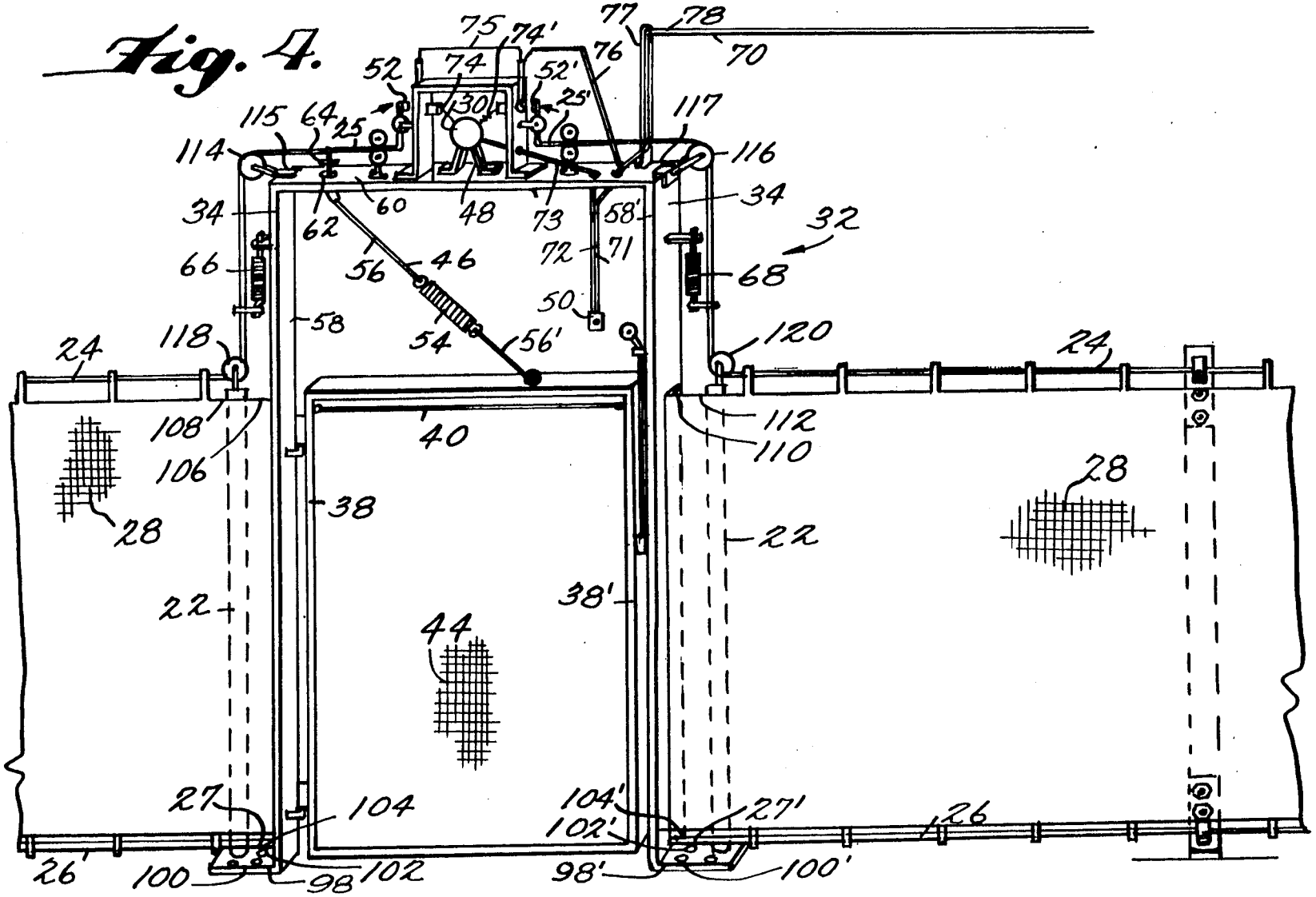
FIG. 4 is a detailed fragmentary front elevation view of the gate and alarm.

With reference now to the drawings wherein like reference characters designate like or corresponding parts throughout the several views, there is shown a security fencing system 20 which includes a plurality of spaced apart substantially vertical supports 22.

A first upper flexible line 24, defining first and second ends 25, 25', extends between and is slidably supported by supports 22. A first lower support 26 also extends between and is supported by vertical supports 22. A first flexible netting 28 is attached to and extends between line 24 and lower support 26.

Means 30 for sounding an audible alarm signal are provided, and ends 25, 25' of line 24 are in operative relationship with sounding means 30 for enabling activation of an alarm signal when netting 28 and flexible line 24 are pulled downwardly, as by the weight of an intruder. Gate means 32 are provided between first and second of vertical supports 22, and gate means 32 preferably include a gate frame 34 and a gate 36 hingedly attached to gate frame 34. Gate 36 preferably includes two opposed substantially vertical frame members 38, 38'.

A second upper flexible line 40 extends between vertical frame members 38, 38', and a second lower support 42 extends between frame members 38, 38'. A second flexible netting 44 is attached to and extends between flexible line 40 and lower support 42. Means 46 are provided in operative relationship with second upper flexible line 40 and with sounding means 30 for enabling activation of alarm signal 48 when netting 44 and flexible line 40 are pulled downwardly, as by the weight of an intruder.

In accordance with the invention, alarm activation enabling means 46 are positioned in operative relationship with gate 36 for enabling activation of alarm signal 48 when the gate is opened. Means 50 for enabling the selective deactivation of alarm sounding means 30 are positioned adjacent to gate 36 and in operative relationship with alarm sounding means 30, and alarm sounding means 30 are preferably positioned on gate frame 34.

More specifically, alarm sounding means 30 include an audible alarm 48 mounted on gate frame 34 for electrical connection to a conventional source of electrical power (not shown). Alarm deactivation means 50 is provided in electrical circuit relationship between the source of electrical power and alarm 48. Alarm sounding means 30 further include a first normally open electrical switch 52 connected to first end 25 of flexible line 24 and in electrical circuit relationship between alarm 48 and the source of electrical power. Alarm sounding means 30 further include a second normally open electrical switch 52' connected to second end 25' of flexible line 24 and in electrical circuit relationship between alarm 48 and the source of electrical power whereby downward pulling on flexible netting 28 and on upper flexible line 24 causes one or both of switches 52, 52' to be closed to activate alarm 48 if the activation means 50 has not been operated.

In accordance with the invention, alarm activation enabling means 46 preferably include a spring 54, a third flexible line 56 connected between spring 54 and first upper flexible line 24, and a fourth flexible line 58 connected between spring 54 and second upper flexible line 40.

Gate frame 34 preferably defines two opposed substantially vertical side elements 58, 58', and a substantially horizontal element 60 extends between vertical side elements 58, 58' and is positioned above gate 36. Horizontal element 60 defines a first aperture 62 therein, and flexible line 56 extends through aperture 62.

A stop member 64, larger in horizontal dimensions than the horizontal dimensions of aperture 62, is attached to flexible line 56 above aperture 62 for limiting downward movement of flexible line 56 and of flexible line 24.

A first adjustable spring element 66 is connected between gate frame 34 and flexible line 24 for controlling the normal position of flexible line 24, and a second adjustable spring element 68 is connected between gate frame 34 and flexible line 24 for controlling the normal position of flexible line 24. More specifically, each of adjustable springs 66, 68 act to adjust the force on ends 25, 25' of line 24, respectively, with respect to switches 52, 52' so that switches 52, 52' are positioned in normally open circuit configurations. As a result, only the weight of an intruder on netting 28 or netting 44 will cause normally open switches 52 and/or 52' to be closed.

The closing of switch 52, for example, results in activation of audible alarm signal 48 from the electrical source of power through electrical conductors 70, 71, 72, 73, 74, 75, 76 and 78. Similarly, closing of electrical switch 52' causes activation of audible alarm signal 48 from the source of electrical power and through electrical conductors 70, 71, 72, 73, 74', 76 and 78.

Each of vertical supports 22 includes a post 80 defining an upper bracket element 82 and a lower bracket element 84. Upper bracket element 82 defines a first opening 86 therein for slidably receiving flexible line 24 which passes through opening 86. Lower bracket element 84 defines a second opening 88 therein for receiving lower support 26 which passes through opening 88. Means 90 are attached to post 80 for mounting the post in a fixed, substantially vertical position with respect to the ground or other supporting surface. Mounting means 90 preferably include a plate 92 welded or otherwise attached to the base of post 80 and bolts 94 extending through openings in plate 92 for attaching the post to the ground or concrete pads 96.

Similarly, means 98, 98' are attached to vertical side elements 58, 58', respectively, for mounting the side elements in fixed, substantially vertical positions with respect to the ground, concrete pads, or other supporting surface. Mounting means 98 includes a plate 100 welded or otherwise attached to the bottom end of side element 58, and a plurality of bolts 102 extend through apertures in plate 100 for engaging a concrete pad or the ground. Likewise, mounting means 98' include a plate 100' welded or otherwise attached to the bottom end of side element 58', and a plurality of bolts 102' extend through openings in plate 100' to engage the ground or a concrete pad.

Lower support 26 defines a first end 27 and a second end 27', and means 104, 104' are attached to vertical side elements 58, 58', respectively, for holding ends 27, 27' of lower support 26. Holding means 104, 104' may include conventional turnbuckles, or springs may be attached between ends 27, 27' and vertical side elements 58, 58', respectively, for allowing movement of ends 27, 27' in the event an intruder attempts to climb the fence.

A third spring element 106 is attached to vertical side element 58, and a first cable 108 is attached to netting 28 and is connected between spring element 106 and flexible line 24. Similarly, a fourth spring element 110 is attached to vertical side element 58', and a second cable 112 is attached to netting 28 and is connected between spring element 110 and flexible line 24. As a result, any spaces between vertical side elements 58, 58' and adjacent ones of vertical supports 22 are covered by netting 28 to prevent a child from squeezing between gate frame 34 and adjacent vertical supports 22.

It may frequently be the case that the height of gate frame 34 will exceed the height of the safety fence and of netting 28. In this configuration, system 20 includes a first pulley 114 mounted on gate frame 34 adjacent to a first end 115 of horizontal element 60 for supporting flexible line 24. A second pulley 116 is mounted on gate frame 34 adjacent to a second end 117 of horizontal element 60 for supporting flexible line 24. A third pulley 118 is mounted on a predetermined one of vertical supports 22 immediately adjacent to side element 58 for receiving flexible line 24, and the fourth pulley 120 is mounted on a predetermined one of vertical supports 22 immediately adjacent to vertical side element 58' for receiving flexible line 24.

The size of the openings in netting 28 and netting 44 may vary, but it is preferred that the size of the openings in the netting be small enough to prevent a child from getting a foothold or a toehold in the openings. A preferred size for the openings in the netting would be such that a spherical object four inches in diameter cannot be passed through the openings. Local statutes may govern the size of the openings required.

Posts 80 and bracket elements 82, 84 may be manufactured as one-piece elements. Alternatively, bracket elements 82, 84 may be separate from and attached to post 80 by means of conventional bolts 122 and nuts 124.

In operation, posts 80 are positioned vertically at spaced apart intervals and are attached to the ground or pads 96 by means of bolts 94. Gate frame 34 is also attached to concrete pads or the ground by means of bolts 102, 102'. Ends 25, 25' of flexible line 24 are attached to electrical switches 52, 52' in a conventional manner, and line 24 is passed over and around pulleys 114, 118, 116 and 120. Line 24 is also passed through openings 86 in supports 22, and netting 28 is connected between line 24 and lower support 26. Audible alarm signal 48 is electrically connected to a conventional source of electrical power (not shown) via conductors 70, 78.

Alarm deactivation means 50 is typically suspended via electrical conductors 71, 72 from horizontal element 60 of gate frame 34. A conventional switch is provided with alarm deactivation means 50, and the switch is positioned above gate 32. It is important that alarm deactivation means 50 be out of reach of small children but conveniently within the reach of an adult so that an adult can simultaneously deactivate alarm 48 when gate 36 is opened. Deactivation is simply accomplished by an adult depressing the conventional switch on deactivation means 50 as the gate is opened and by maintaining the switch depressed until the gate is returned to its closed position. This will prevent audible alarm 48 from sounding while the gate is being opened and closed.

If a child attempts to climb the fence and pulls on netting 28, the weight of the child will cause movement of flexible line 24 and closing of one or both of electrical switches 52, 52'. This, in turn, will result in activation of audible alarm signal 48.

If a small child attempts to gain access to the swimming pool by climbing over gate 36, netting 44 and flexible line 40 will move downwardly from the weight of the child. This, in turn, will cause downward movement of lines 56, 56' and spring 54, and because line 56 is connected to line 24 at connection 57, line 24 will move. This will cause switch 52 to be closed, and audible alarm signal 48 will be activated.

The security fencing system 20 provides an effective and inexpensive way to prevent unsupervised children from gaining access to swimming pools and other areas. The invention in its broader aspects is not limited to the specific details shown and described, and departures may be made from such details without departing from the principles of the invention and without sacrificing its chief advantages.

What is claimed is:

1. A security fencing system, comprising:

a plurality of spaced apart substantially vertical supports;

a first upper flexible line defining first and second ends and extending between and slidably supported by said vertical supports;

a first lower support extending between said vertical supports;

a first flexible netting attached to and extending between said first line and said lower support;

means for sounding an audible alarm signal;

said first and second ends of said first line in operative relationship with said sounding means for enabling activation of said alarm signal when said first netting and said first line are pulled downwardly, as by the weight of an intruder; and gate means between a first and second of said vertical supports;

said gate means including;

a gate frame, a gate hingedly attached to said gate frame, said gate including two opposed substantially vertical frame members, a second upper flexible line extending between said vertical frame members, a second lower support extending between said vertical frame members, a second flexible netting attached to and extending between said second line and said second lower support, and means in operative relationship with said second flexible line and said sounding means for enabling activation of said alarm signal when said second netting and said second line are pulled downwardly, as by the weight of an intruder, said activation enabling means positioned in operative relationship with said gate for enabling activation of said alarm signal when said gate is opened.

2. A system as in claim 1 further including means positioned adjacent to said gate and in operative relationship with said alarm sounding means for enabling the selective deactivation of said alarm sounding means.

3. A system as in claim 2 wherein said alarm sounding means is positioned on said gate frame.

4. A system as in claim 3 wherein said alarm sounding means include:

an audible alarm mounted on said gate frame for electrical connection to a source of electrical power;

said deactivation means in electrical circuit relationship between said power source and said alarm;

a first normally open electrical switch connected to said first end of said first flexible line and in electrical circuit relationship between said alarm and said power source; and a second normally open electrical switch connected to said second end of said first flexible line and in electrical circuit relationship between said alarm and said power source, whereby downward pulling on said first flexible netting and on said first flexible line causes one or both of said switches to be closed to activate said alarm if said deactivation means has not been operated.

5. A system as in claim 4 wherein said activation enabling means include:

a spring;

a third flexible line connected between said spring and said first upper flexible line; and a fourth flexible line connected between said spring and said second upper flexible line.

6. A system as in claim 5 wherein said gate frame defines two opposed substantially vertical side elements and a substantially horizontal element extending between said vertical side elements and positioned above said gate, said horizontal element defining a first aperture therein and said third flexible line extending through said first aperture.

7. A system as in claim 6 further including a stop member larger in horizontal dimensions than the horizontal dimensions of said first aperture, said stop member attached to said third flexible line above said first aperture.

8. A system as in claim 7 further including:

a first adjustable spring element connected between said gate frame and said first flexible line for controlling the normal position of said first flexible line; and a second adjustable spring element connected between said gate frame and said first flexible line for controlling the normal position of said first flexible line.

9. A system as in claim 8 wherein each of said vertical supports includes:

a post defining upper and lower bracket elements;

said upper bracket element defining a first opening therein for slidably receiving said first upper line which passes through said first opening;

said lower bracket element defining a second opening therein for receiving said first lower support which passes through said second opening; and means attached to said post for mounting said post in a fixed, substantially vertical position with respect to the ground or other supporting surface.

10. A system as in claim 6 further including means attached to said vertical side elements for mounting said side elements in a fixed, substantially vertical position with respect to the ground or other supporting surface.

11. A system as in claim 10 wherein said first lower support defines first and second ends and further including means attached to said vertical side elements for holding said ends of said first lower support.

12. A system as in claim 11 further including:

a third spring element attached to a first of said vertical side elements;

a first cable attached to said netting and connected between said third spring element and said first flexible line;

a fourth spring element attached to a second of said vertical side elements; and a second cable attached to said netting and connected between said fourth spring element and said first flexible line, whereby any spaces between said first and second vertical side elements and adjacent ones of said vertical supports are covered by said netting.

13. A system as in claim 12 further including:

a first pulley mounted on said gate frame adjacent to a first end of said horizontal element for supporting said first flexible line;

a second pulley mounted on said gate frame adjacent to a second end of said horizontal element for supporting said first flexible line;

a third pulley mounted on a predetermined one of said vertical supports immediately adjacent to said first vertical side element for receiving said first flexible line; and a fourth pulley mounted on a predetermined one of said vertical supports immediately adjacent to said second vertical side element for receiving said first flexible line.

* * * * *